US007404408B2

(12) United States Patent
Clemons

(10) Patent No.: US 7,404,408 B2
(45) Date of Patent: Jul. 29, 2008

(54) WASHER-JET VERIFICATION APPARATUS

(75) Inventor: Daniel L. Clemons, Burton, MI (US)

(73) Assignee: General Motors Corporation, Detroit, MI (US)

( * ) Notice: Subject to any disclaimer, the term of this patent is extended or adjusted under 35 U.S.C. 154(b) by 629 days.

(21) Appl. No.: 10/992,530

(22) Filed: Nov. 18, 2004

(65) Prior Publication Data

US 2006/0102214 A1 May 18, 2006

(51) Int. Cl.
*B08B 3/02* (2006.01)

(52) U.S. Cl. ..... 134/113; 134/201

(58) Field of Classification Search ..... 134/113, 134/201

See application file for complete search history.

(56) References Cited

U.S. PATENT DOCUMENTS 3,608,514 A * 9/1971 Dunn ..... 116/228
4,129,954 A * 12/1978 Hulteen ..... 40/606.03
4,653,423 A * 3/1987 Schafer ..... 116/228
D345,829 S * 4/1994 Mancuso et al. ..... D32/3
5,477,872 A * 12/1995 Berg ..... 134/52
5,839,458 A * 11/1998 Delcarson ..... 134/113
5,884,641 A * 3/1999 Berg ..... 134/113
6,196,239 B1 * 3/2001 Eskey ..... 134/113
6,427,708 B1 * 8/2002 Jermyn ..... 134/113
6,962,070 B1 * 11/2005 Tanner et al. ..... 73/12.07
2007/0053791 A1 * 3/2007 Bancroft ..... 422/61

FOREIGN PATENT DOCUMENTS

DE 41 01 731 * 7/1992
WO WO 03/023534 * 3/2003

* cited by examiner

*Primary Examiner*—Frankie L Stinson

(57) ABSTRACT

A washer-jet verification master is employed to determine the correct alignment of washer nozzles within a production machine. The verification master includes a plurality of targets, which are preset to a first position. The verification master is placed in the production machine the water jets are actuated and if properly aligned will move the targets to a second position, which indicates proper operation.

7 Claims, 3 Drawing Sheets

WASHER-JET VERIFICATION APPARATUS

TECHNICAL FIELD

This invention relates to apparatus for ensuring proper tooling and, more particularly, to ensuring the proper alignment of washer-jets in a cleaning apparatus on a production line.

BACKGROUND OF THE INVENTION

Many components, such as fluid couplings and engines, require a water cleansing operation in production. The water cleansing is quite often performed by a plurality of positioned jets, which direct the cleaning fluid into the desired compartments of the component to be cleaned. For example, with fluid couplings, the water jet is aimed to displace foreign material lodged between the adjacent vanes of the fluid coupling components.

If the cleaning fluid jets are not properly aligned, the likelihood of foreign matter remaining within the component increases. The addition of foreign matter to the component during production and not cleaned will result in a unit that does not pass final test and therefore must be disassembled and cleaned before the component can be installed within the overall assembled apparatus.

SUMMARY OF THE INVENTION

It is an object of the present invention to provide an improved verification apparatus for production line usage.

In one aspect of the present invention, a plurality of targets is arranged within an application master.

In another aspect of the present invention, the targets are spring-loaded to an uncorrected position.

In still another aspect of the present invention, the targets are maintained in the uncorrected position by spring-actuated mechanisms.

In yet another aspect of the present invention, the targets are deflected to an actuated position when placed in a production environment and the water jets are properly aligned.

In yet still another aspect of the present invention, the targets are positionable to the uncorrected position by a tool, which operates on the targets.

DESCRIPTION OF AN EXEMPLARY EMBODIMENT

Figure 1:
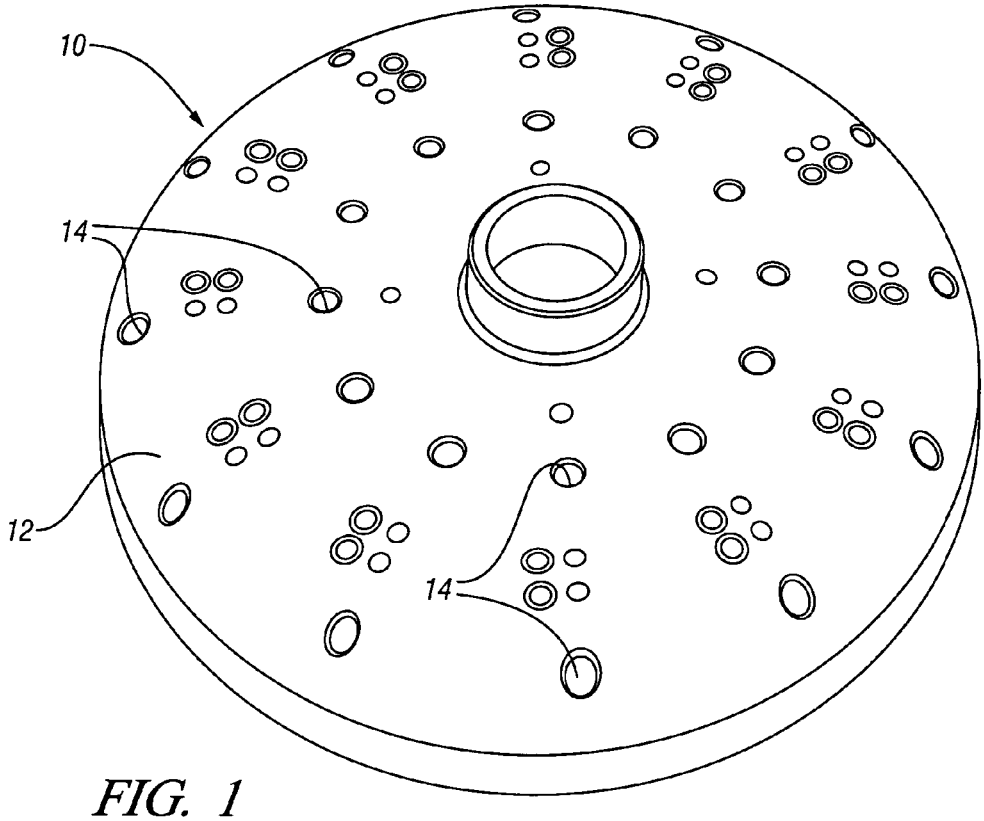
FIG. 1 is a top view of the verification master.

Referring to the drawings, wherein like characters represent the same or corresponding parts throughout the several views, there is seen in FIG. 1 a verification master, generally designated 10. The verification master, in embodiment shown, is made up to provide testing of water cleansing of a fluid coupling pump mechanism. However, those skilled in the art will readily recognize that the test verification apparatus can be sized and designed to accommodate any product that needs water cleansing through the use of high pressure jets. The verification master 10 has a shell 12 in which a plurality of openings 14 is formed. The outer surface of the shell 12 is substantially the same shape as a torque converter or fluid coupling pump member.

Figure 2:
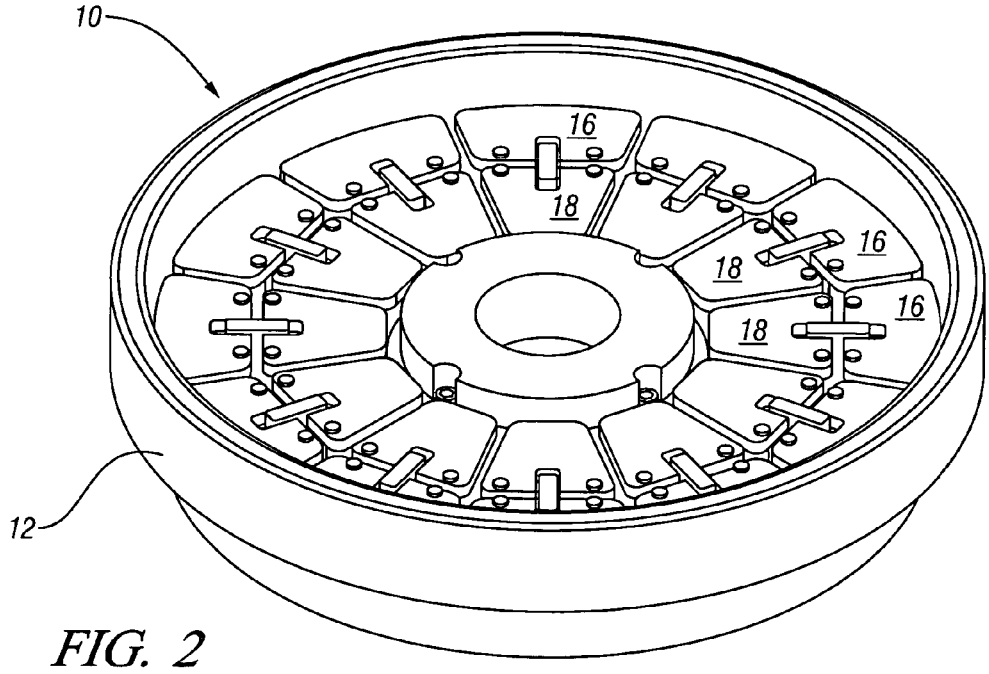
FIG. 2 is a bottom view of the verification master.

In FIG. 2, the verification master 10 is seen from a bottom view wherein a plurality of targets 16 and 18 are arranged about the inner area or volume of the verification master 10.

Figure 4:
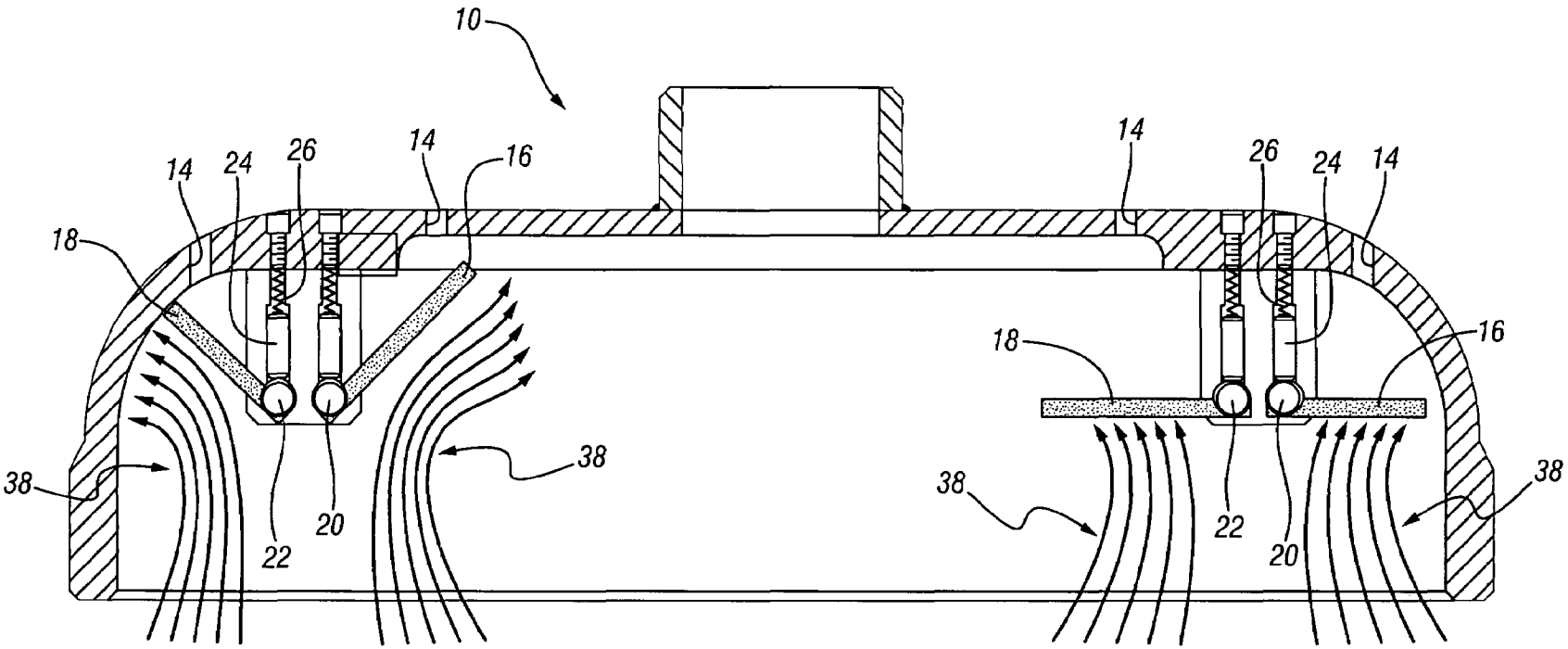
FIG. 4 is a diagrammatic representation of a cross section of the verification master showing the targets in an uncorrected position and in a corrected position.

As best seen in FIG. 4, each of the targets 16 and 18 have formed thereon cam members 20 and 22, respectively. The cam members 20 are abutted by a spring plunger 24 and the cam members 22 are each abutted by a spring member 26.

Figure 3:
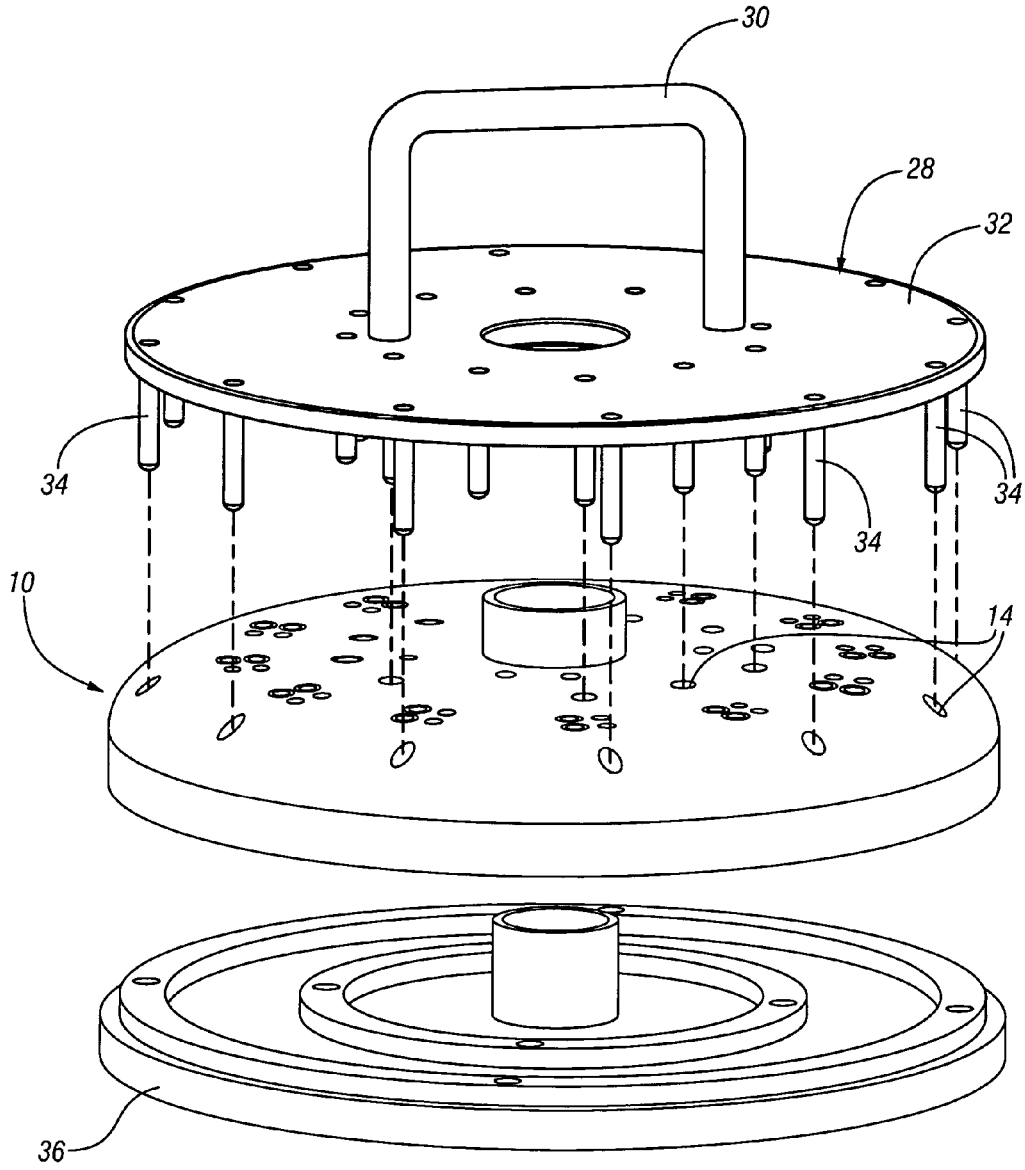
FIG. 3 is an isometric exploded view of a reset tool for the verification master.

As seen in FIG. 3, a reset tool 28 has a handle portion 30, a disc portion 32, and a plurality of peg members 34. The master 10 is placed on a base 36. The peg members 34 are alignable with the openings 14. On insertion of the pegs 34 through the openings 14, the targets 16 and 18 are engaged by the pegs 34 to place the targets in the unactuated or uncorrected position. When all of the targets are placed in the uncorrected or unactuated position, as shown in the right hand side of FIG. 4, the verification master 10 is placed over the work tool or washing tool to be validated and water jets represented by the lines 38 are directed from the production cleaning machine toward the targets 16 and 18.

If the water jets within the production machine are properly aligned to provide the required cleaning, the targets 16 and 18 will be actuated to the position shown on the left hand side of FIG. 4, which is the correct position for the water jets when they are properly operated.

After testing the apparatus, the operator can review the verification master 10 and determine if all of the jets are properly operating. The jets that are not properly operating will be indicated by the targets 16 or 18 remaining in the uncorrected position. This will permit the operator to readjust or replace the water jets that were not properly operating. This will also ensure a better product.

The invention claimed is:

1. A verification apparatus for a washer having fluid jets for directing cleaning fluid at a component, said apparatus comprising:

a body simulating component adapted to be mounted on said washer;

a plurality of targets disposed in a first position to receive fluid from said fluid jets; and means for holding said targets in a first position and for permitting movement of said targets to a second position in response to fluid from said jets to indicate proper alignment thereof.

2. The verification apparatus defined in claim 1 further comprising:

said means for holding said targets including resilient means and cam means, said resilient means comprising spring-loaded plungers.

3. The verification apparatus defined in claim 1 further comprising:

reset tool means having extensions extendable through a plurality of openings in said body to engage said targets to ensure each target is returned to the said first position.

4. A verification apparatus for a washer having fluid jets for directing cleaning fluid at a component, said apparatus comprising:

a body simulating component for replicating the component adapted to be mounted on said washer;

a plurality of targets disposed in a first position to receive fluid from said fluid jets; and resilient means and cam means, said resilient means comprising spring-loaded plungers, for holding said targets in a first position and for permitting movement of said targets to a second position in response to fluid from said jets to indicate proper alignment thereof.

5. The verification apparatus defined in claim 4 further comprising:

reset tool means having extensions extendable through a plurality of openings in said body to engage said targets to ensure each target is returned to the said first position.

6. A verification apparatus for a washer having fluid jets for directing cleaning fluid at a component, said apparatus comprising:

a body simulating component for replicating the component adapted to be mounted on said washer;

a plurality of targets disposed in a first position to receive fluid from said fluid jets;

means for holding said targets in a first position and for permitting movement of said targets to a second position in response to fluid from said jets to indicate proper alignment thereof; and reset tool means having extensions extendable through a plurality of openings in said body to engage said targets to ensure each target is returned to the said first position.

7. The verification apparatus defined in claim 6 further comprising:

said means for holding said targets including resilient means and cam means, said resilient means comprising spring-loaded plungers.

* * * * *